US008351822B2

(12) United States Patent
Yamada

(10) Patent No.: US 8,351,822 B2
(45) Date of Patent: Jan. 8, 2013

(54) COVER UNIT AND PRINTER

(75) Inventor: Masahiko Yamada, Omi-mura (JP)

(73) Assignee: Seiko Epson Corporation, Tokyo (JP)

( * ) Notice: Subject to any disclaimer, the term of this patent is extended or adjusted under 35 U.S.C. 154(b) by 36 days.

(21) Appl. No.: 12/973,849

(22) Filed: Dec. 20, 2010

(65) Prior Publication Data

US 2011/0146158 A1 Jun. 23, 2011

(30) Foreign Application Priority Data

Dec. 21, 2009 (JP) ..... 2009-288750

(51) Int. Cl.
*B41J 21/12* (2006.01)

(52) U.S. Cl. ..... 399/125; 399/380

(58) Field of Classification Search ..... 399/124, 399/125, 107, 380; 49/386
See application file for complete search history.

(56) References Cited

U.S. PATENT DOCUMENTS

| | | | | |
|---|---|---|---|---|
| 6,118,469 | A * | 9/2000 | Hosomi | 347/222 |
| 6,565,273 | B2 * | 5/2003 | Yamada | 400/512 |
| 7,320,462 | B2 * | 1/2008 | Takamatsu | 271/3.14 |
| 2001/0014242 | A1 * | 8/2001 | Yamada | 400/594 |
| 2005/0069370 | A1 * | 3/2005 | Yamada et al. | 400/663 |
| 2006/0029425 | A1 * | 2/2006 | Tomatsu | 399/125 |
| 2006/0165467 | A1 * | 7/2006 | Kawakami et al. | 400/613 |
| 2007/0269250 | A1 * | 11/2007 | Nelson et al. | 400/691 |
| 2009/0129846 | A1 * | 5/2009 | Ishida et al. | 400/613 |

FOREIGN PATENT DOCUMENTS

| | | | |
|---|---|---|---|
| JP | 11-157188 | A | 6/1999 |
| JP | 2001-253143 | A | 9/2001 |
| JP | 2007-044940 | A | 2/2007 |

* cited by examiner

*Primary Examiner* — Katherine W Mitchell
*Assistant Examiner* — Justin Rephann
(74) *Attorney, Agent, or Firm* — Kilpatrick Townsend & Stockton LLP

(57) ABSTRACT

One end of the cover unit of a printer is supported freely rotatably on the device case, and a rotating shaft is disposed with both ends supported freely rotatably on the distal end. A right pressure lever and an operating lever are supported on the right end of the rotating shaft, and a left pressure lever is supported on the left end. When the operating lever rotates, the right and left pressure lever rotate in the same direction through an intervening rotation transfer member extending widthwise to the device. When the operating lever rotates when the cover is closed, the left pressure lever contacts the device case before the right pressure lever . The right and left pressure lever are set so that their rotational positions are the same when the cover starts to rise due to deformation of the rotation transfer member.

7 Claims, 6 Drawing Sheets

COVER UNIT AND PRINTER

This application claims priority to Japanese Patent Application No. 2009-288750, filed Dec. 21, 2009, the entirety of which is incorporated by reference herein.

BACKGROUND

1. Technical Field

The present invention relates to a cover unit that accomplishes a cover opening operation lifting an access cover open from a closed position as a result of operating a lever disposed on one widthwise side of the access cover, one end of which is supported freely pivotably on the case of a printer, and relates to a printer having this cover unit.

2. Related Art

In order to load roll paper into the internal roll paper compartment of a thermal printer or other type of roll paper printer, an opening through which the roll paper can be inserted and removed is formed in the printer case. A cover unit that opens and closes the opening to the roll paper compartment is disposed with one end of an access cover supported freely pivotably on an edge of this opening so that the access cover can swing open and closed pivoting on this end.

Japanese Unexamined Patent Appl. Pub. JP-A-2004-276521 teaches such a thermal printer. The thermal printer taught in JP-A-2004-276521 has a printer cover (access cover) carrying a platen attached to the top of the case. The end of this printer cover at the back of the printer is supported on the printer frame by an intervening rotating support member. A lever disposed in the top of the printer cover is operated to lift and open the printer cover. This lever is formed on one end of an arm that is supported freely pivotably on a pivot point disposed at a front end part of the printer cover. When the lever is operated, the arm pivots and the printer cover lock is released, and a cover lift (a push-up unit) formed on the other end of the arm contacts a cover lift base formed on the printer case. When the arm rotates pivoting on the point of contact with this cover lift base, the printer cover that supports the arm is pushed up. The printer cover can then be manually raised and opened wide.

The configuration taught in JP-A-2004-276521 has the lever disposed on one side of the width of the printer cover, and an arm disposed on both sides of the width of the printer cover. As a result, operation of the lever (the pivoting operation) is transmitted to each of the arms through a rotation transfer member that extends widthwise to the printer cover, and the arms are configured to rotate together in response to operation of the lever.

When the printer cover is pushed up, the load of the weight from the printer cover side acts on the rotation transfer member that transmits the rotation of the lever to the arms. With this configuration, when the lever disposed to one end part of the rotation transfer member is operated, the load (weight) from the printer cover side causes the rotation transfer member to deform as a result of twisting or deflection, and the rotational positions of the arm on the side near the lever and the arm on the side far from the lever differ. As a result, both sides of the width of the printer cover do not start being pushed up at the same time, and the side closest to the lever begins being pushed up first. The printer cover and lever therefore twist or bend when being pushed up, and opening the printer cover smoothly becomes difficult.

SUMMARY

In a configuration that has a lift unit for pushing up the printer cover or other access cover provided on both widthwise sides of the access cover, and has a lever or other operating member disposed on one end of a rotation transfer member that causes the lift units to rotate in unison, a cover unit and a printer having a cover unit according to the invention reduce deformation caused by twisting or bending of the rotation transfer member when the access cover is pushed up and enable smoothly opening and closing the access cover without increasing the thickness or weight of the rotation transfer member.

A first aspect of the invention is a cover unit including: a cover that has one end supported freely rotatably on a device case, and moves between a closed position closed to the device case and an open position where the other end is separated from the device case; a rotation transfer member that is disposed to the other end side of the cover, and extends parallel to the axis of rotation from one side to the other side of the cover; an operating part disposed to one end part of the rotation transfer member; a first pressure part disposed to the end of the rotation transfer member on the same side as the operating part; a second pressure part disposed to the end of the rotation transfer member on the opposite side as the operating part; and first and second pressure-bearing parts that are disposed to the device case and are opposite the first and second pressure parts when the cover is in the closed position; wherein the first and second pressure parts are supported freely rotatably on the same axis of rotation parallel to the axis of rotation of the cover, and when the cover is in the closed position and the operating part is rotated, the rotation is transferred through the rotation transfer member to the first and second pressure parts, the first and second pressure parts rotate, and the second pressure part contacts the second pressure-bearing part before the first pressure part contacts the first pressure-bearing part.

The invention thus disposes a cover on a rotation transfer member that extends parallel to the axis of rotation of the cover from one side to the other side of the cover, disposes first and second pressure parts on one end side and the other end side, disposes an operating part on the end on the same side as the first pressure part, supports the first and second pressure parts and the operating part freely rotatably on the same axis of rotation, and transfers rotation of the operating part to the first and second pressure parts through the rotation transfer member.

When the cover of this configuration is opened, the first and second pressure parts rotate in conjunction with rotation of the operating part and contact corresponding first and second pressure-bearing parts of the device case, and can lift the cover from the device case by pivoting on the pressure-bearing parts. Anticipating an offset between when the pressure part far from the operating part and the pressure part near the operating part start to raise the parts at the opposite sides of the cover width due to twisting or deflection of the rotation transfer member, the invention is configured so that the pressure part far from the operating part (the second pressure part) contacts the pressure-bearing part (second pressure-bearing part) of the device case first.

Even if the load from the cover side causes twisting or bending deformation of the rotation transfer member, this aspect of the invention can reduce or eliminate the difference in the timing when the side of the cover near the operating part and the side far from the operating part start to rise due to this deformation. Deflection of the cover when the cover opens can therefore be reduced or eliminated, and the cover can be opened smoothly. In addition, because deformation of the rotation transfer member does not need to be suppressed by making the rotation transfer member thicker or sturdier, the rotation transfer member can be disposed in a smaller space and the weight of the cover unit can be reduced.

Preferably, the first and second pressure parts respectively contact the first and second pressure-bearing parts when the operating part rotates further after the second pressure part contacts the second pressure-bearing part; and the positions of the first and second pressure parts are set so that when the operating part rotates even further the parts of the cover corresponding to the first and second pressure parts start to move simultaneously toward the open position.

This aspect of the invention enables the parts of the cover corresponding to the first and second pressure parts to start rising simultaneously, and can thereby eliminate deflection of the cover and enable the cover to open smoothly.

In another aspect of the invention, the rotation transfer member is deformed by the load from the cover side when the rotation transfer member transfers rotation of the operating part in the closed position to the first and second pressure parts and causes the cover to move toward the open position; and the positions of the first and second pressure parts are set so that the rotational position of the first pressure parts disposed to the end on the same side as the operating part, and the rotational position of the second pressure part disposed to the end on the opposite side as the operating part, match when the rotation transfer member is deformed.

This aspect of the invention can lift the parts of the cover corresponding to the first and second pressure parts to the same height, and can lift the cover without it bending or deflecting. As a result, the cover can be opened with a smooth action.

In another aspect of the invention, the rotation transfer member is supported at the back side of the cover facing the device case side when in the closed position; and the operating part is an operating lever that extends through the cover from the back side to the front side of the cover.

In addition, the cover can be opened by operating an operating lever from the outside of the cover in the closed position.

In another aspect of the invention, one end of the cover is supported freely rotatably on an edge of an opening rendered in a device case of a printer.

The invention can thus be applied as a large cover unit that covers a large opening disposed in the device case of a printer for replacing roll paper, for example, and enables reducing cover unit weight, and reducing or eliminating bending and deflection of the cover when opening the cover.

In another aspect of the invention a platen roller is mounted on the cover. When a platen roller is carried on the cover, the weight of the platen roller acts on the rotation transfer member through the cover. This aspect of the invention enables reducing or eliminating deflection or bending of the cover when opening the cover without making the rotation transfer member thicker or sturdier even when the cover unit imposes a heavy load. The cover can therefore be opened with a smooth action.

Another aspect of the invention is a printer that has the cover unit described above.

EFFECT OF THE INVENTION

When opening a cover unit of which one end is supported freely rotatably on a device case, the invention can reduce or eliminate a difference in the time when the parts of the cover on the sides near the operating part and far from the operating part start to rise due to the rotation transfer member twisting due to the load from the cover side. Deflection or bending of the cover during opening can therefore be reduced or eliminated, and the cover can be opened with a smooth action. Furthermore, because twisting deformation of the rotation transfer member does not need to be suppressed by making the rotation transfer member thick and sturdy, the rotation transfer member can be disposed in a smaller space and cover unit weight can be reduced.

Other objects and attainments together with a fuller understanding of the invention will become apparent and appreciated by referring to the following description and claims taken in conjunction with the accompanying drawings.

DESCRIPTION OF EMBODIMENTS

Figure 1:
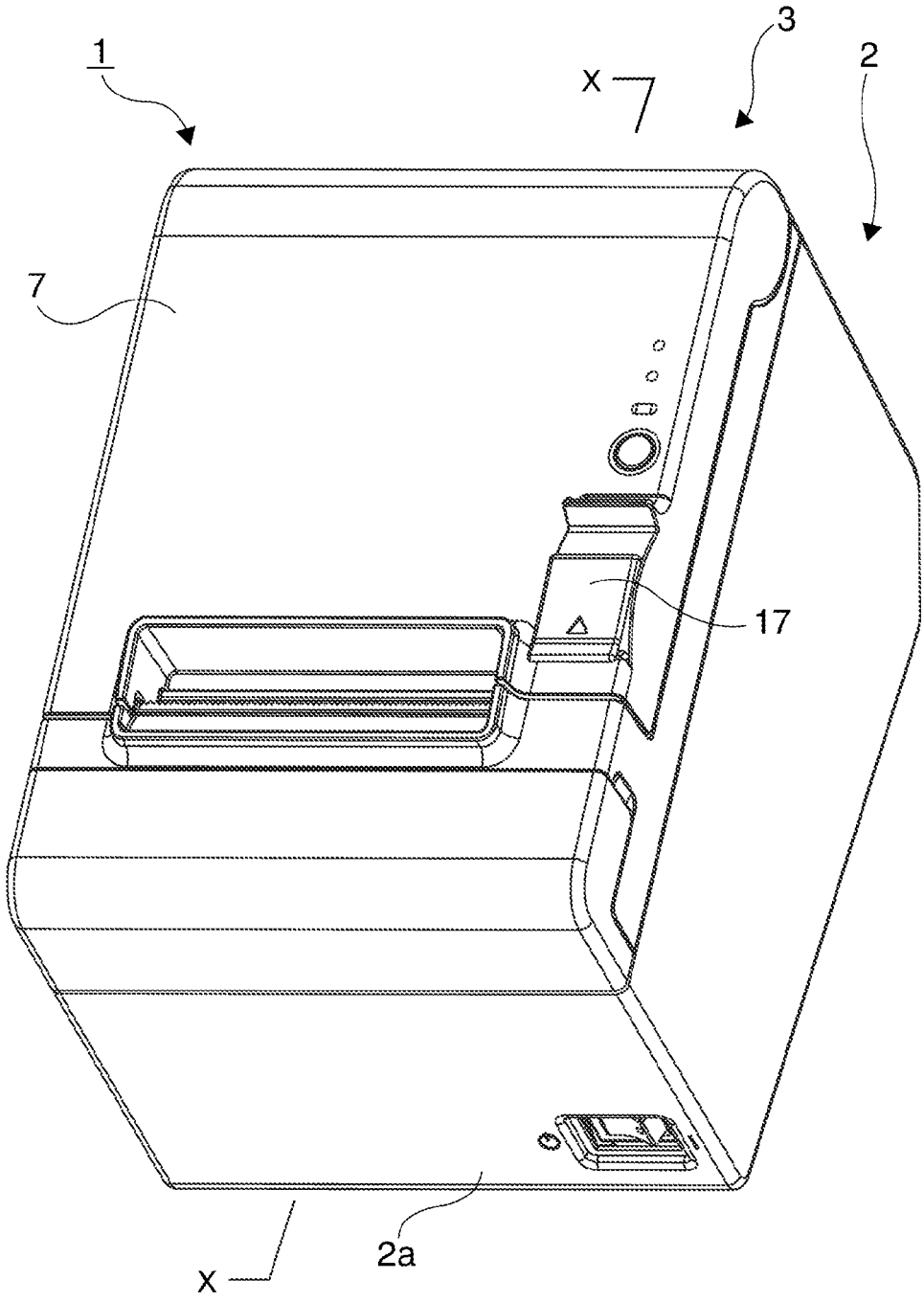
FIG. 1 is an external oblique view of a printer with the cover unit closed.
Figure 2:
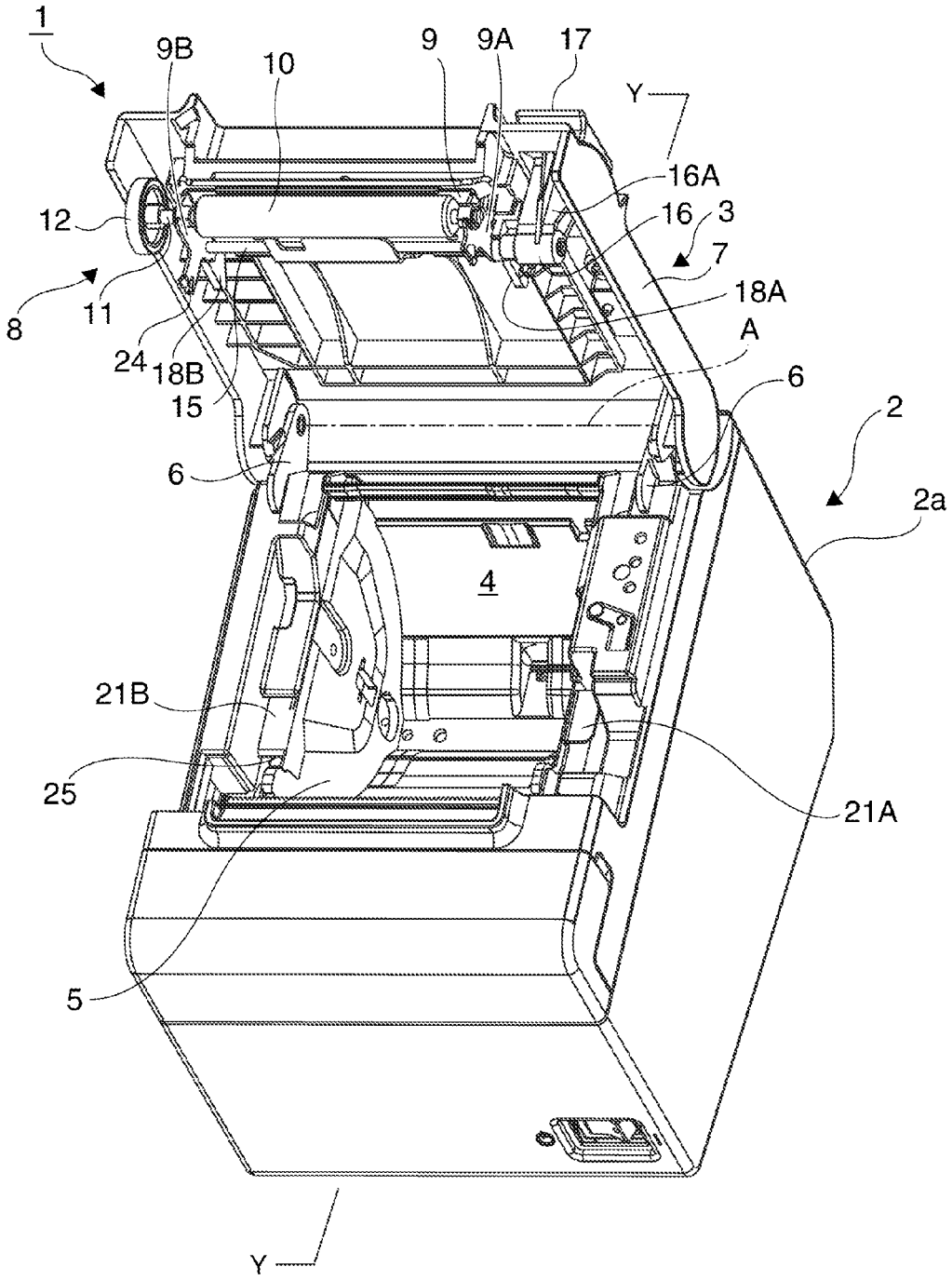
FIG. 2 is an external oblique view of the printer with the cover unit open.
Figure 3:
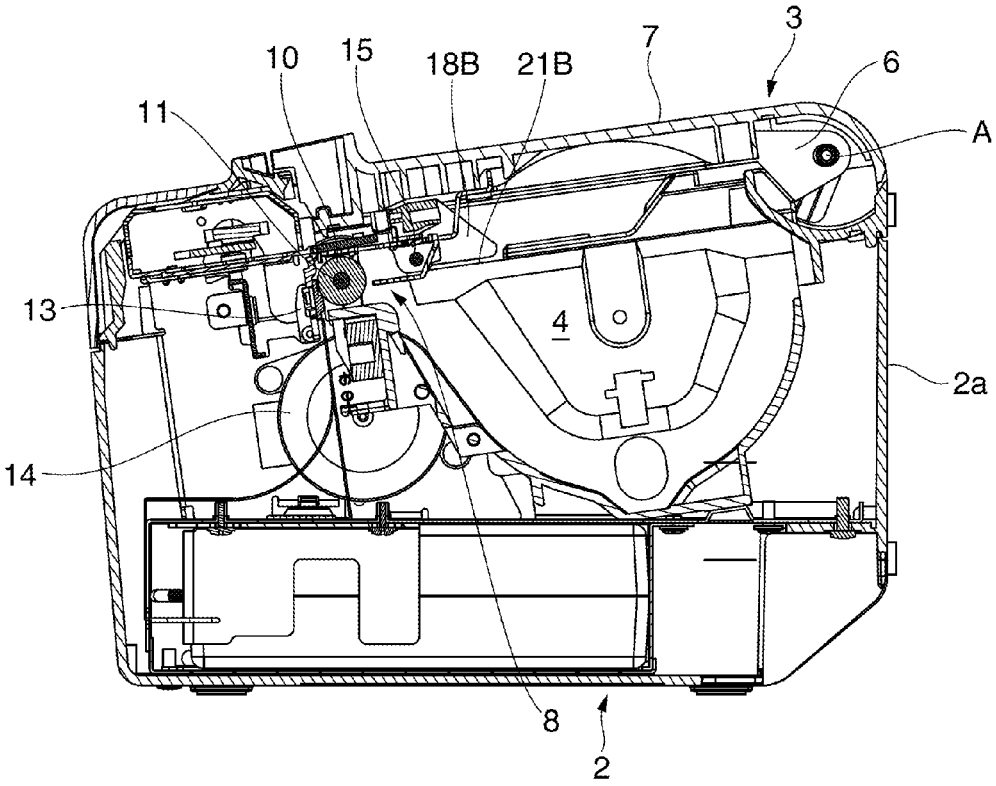
FIG. 3 is a section view of the printer with the cover unit closed as seen through line X-X in FIG. 1.
Figure 4:
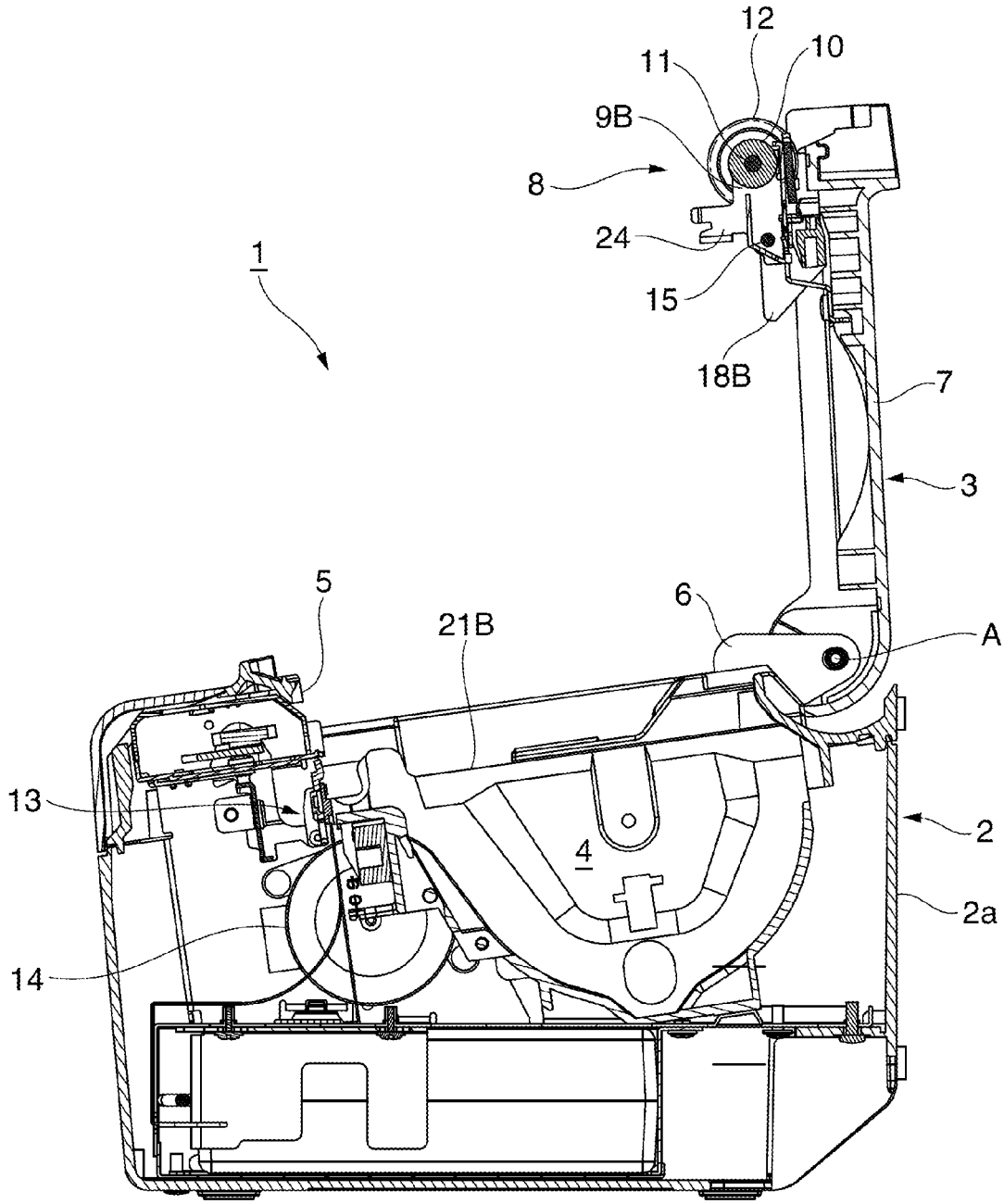
FIG. 4 is a section view of the printer with the cover unit open as seen through line Y-Y in FIG. 2.

Preferred embodiments of a cover unit and a printer having a cover unit according to the present invention are described below with reference to the accompanying figures. FIG. 1 is an external oblique view of the printer with the cover unit closed, and FIG. 2 is an external oblique view of the printer with the cover unit open. FIG. 3 is a section view of the printer with the cover unit closed as seen through line X-X in FIG. 1, and FIG. 4 is a section view of the printer with the cover unit open as seen through line Y-Y in FIG. 2. General configuration As shown in FIG. 1 to FIG. 4, the printer 1 has a housing 2 and a cover unit 3 attached to the top of the housing 2. The printer 1 in this embodiment of the invention is a thermal printer, and a roll paper compartment 4 in which the roll paper is loaded is rendered inside the case member 2*a* of the housing 2. An opening 5 for loading and removing roll paper is formed in the case member 2*a* above the roll paper compartment 4. Cover unit installation parts 6 are disposed to the left and right side ends of the opening 5 at the back side of the printer.

The cover unit 3 includes an access cover 7 that is the same width as the case member 2*a* of the housing 2, and the cover unit installation parts 6 are attached freely pivotably to the inside of the left and right sides at the back end of the access cover 7. This enables the cover unit 3 to pivot freely on an axis of rotation A passing through the cover unit installation parts 6. When the front end of the cover unit 3 is lifted up and the cover unit 3 rotates and moves to the open position shown in FIG. 2 and FIG. 4, roll paper can be loaded into and removed from the roll paper compartment 4. When the front end of the cover unit 3 is lowered and the cover unit 3 swings down to the closed position along the housing 2 as shown in FIG. 1 and FIG. 3, the opening 5 can be closed by the cover unit 3. At this closed position a paper exit is formed between the edge of the opening 5 at the front of the printer and the front end part of the cover unit 3.

Cover Opening and Closing Mechanism

Figure 5:
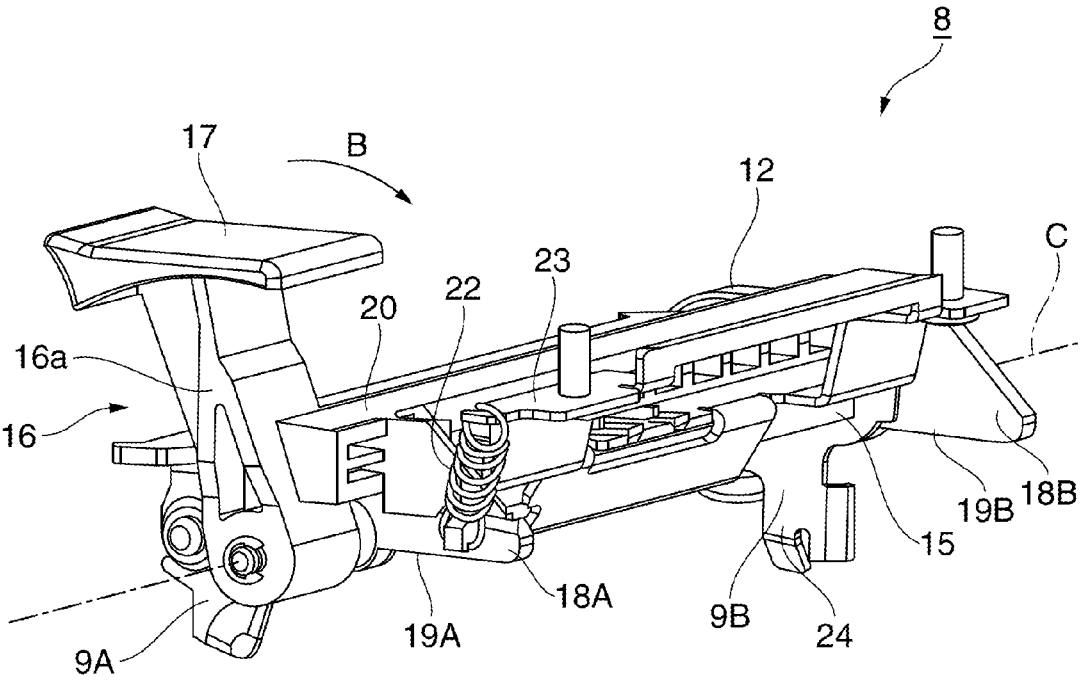
FIG. 5 is an oblique view of the cover opening and closing mechanism.

A cover opening and closing mechanism 8 is disposed to the cover unit 3 below the front end part of the access cover 7. FIG. 5 is an oblique view of the cover opening and closing mechanism. The cover opening and closing mechanism 8 includes a support frame 9 that extends widthwise to the printer along the bottom of the access cover 7. Support plates 9A and 9B that extend curving down are rendered at the opposite sides of the width of the support frame 9.

A platen roller 10 is supported freely rotatably by the cover opening and closing mechanism 8. More specifically, the rotating spindle 11 of the platen roller 10 extends parallel to the axis of rotation A of the cover unit 3 with both ends of the spindle supported freely rotatably by the support plates 9A and 9B near the front end of the cover unit. One end of the rotating spindle 11 passes through support plate 9B and has a paper feed gear 12 attached to the end. When the cover unit 3 closes, the platen roller 10 carried on the cover unit 3 is pressed against a printhead 13 disposed in the housing 2. A transmission gear not shown disposed in the housing 2 meshes with the paper feed gear 12 at this time, and paper feed motor 14 output is transferred to the platen roller 10 through the transmission gear and paper feed gear 12. As a result, recording paper fed from the roll paper can be held and fed between the printhead 13 and platen roller 10 while the printhead 13 prints on the recording paper.

The ends of a rotating support shaft 15 that extends parallel to the rotating spindle 11 are supported freely rotatably on the support plates 9A and 9B at positions closer to the back end side of the cover unit than where the rotating spindle 11 is supported. Like the rotating spindle 11, this rotating support shaft 15 is parallel to the axis of rotation A of the cover unit 3. The end of the rotating support shaft 15 on the support plate 9A side (the right side of the printer) passes through the support plate 9A and extends widthwise to the outside of the support frame 9, and the base end part of an operating lever 16 (operating part) is attached to this outside end of the rotating support shaft 15. The arm part 16*a* of the operating lever 16 extends passing through the access cover 7 as shown in FIG. 1 and FIG. 2, and a finger catch 17 is formed extending along the surface of the access cover 7 on the part of the arm part 16*a* exposed at the surface of the access cover 7. When the cover unit 3 is closed, the operating lever 16 can be operated and made to pivot by manually sliding the finger catch 17 from above the cover unit 3

A right pressure lever 18A (first pressure part disposed on the same side as the operating part) that extends to the back of the printer is attached to the rotating support shaft 15 between the operating lever 16 and support plate 9A.

The end of the rotating support shaft 15 on the support plate 9B side (the left side of the printer) passes through the support plate 9B and protrudes slightly from the left side of the support plate 9B, and a left pressure lever 18B (second pressure part disposed to the end on the opposite side as the operating part) that extends to the back of the printer is attached to this end of the rotating support shaft 15.

The three members including the operating lever 16, right pressure lever 18A, and left pressure lever 18B are thus supported freely rotatably on the axis of rotation C of the rotating support shaft 15. The right pressure lever 18A and left pressure lever 18B are basically triangular plates, and the bottom edges 19A, 19B thereof extend substantially the same length in the front-back direction of the cover unit 3. The tops edges of the right pressure lever 18A and left pressure lever 18B are inclined sides that rise diagonally toward the front of the cover unit.

The left end part and right end part of a rotation transfer member 20 that extends widthwise to the printer contact or are affixed from the cover unit side to the right pressure lever 18A and left pressure lever 18B at positions toward the front of the cover unit. The end of the rotation transfer member 20 on the right pressure lever 18A side contacts the arm part 16*a* of the operating lever 16 extending from the rotating support shaft 15 to the finger catch 17 from the back side of the cover unit. When the operating lever 16 is rotated toward the back of the cover unit (the direction of arrow B in FIG. 5) with this configuration, rotation of the arm part 16*a* is transferred through the rotation transfer member 20 to the right pressure lever 18A and left pressure lever 18B, and the right pressure lever 18A and left pressure lever 18B rotate down.

The bottom edge 19A of the right pressure lever 18A opposes a pressure surface 21A (first pressure-bearing part) disposed on the edge of the housing 2 on the right side of the opening 5. The bottom edge 19B of the left pressure lever 18B likewise opposes a pressure surface 21B (second pressure-bearing part) disposed on the edge of the housing 2 on the left side of the opening 5. When the cover unit 3 is closed, there is a specific gap between the bottom edge 19A and pressure surface 21A, and between the bottom edge 19B and pressure surface 21B.

As shown in FIG. 5, one end of a coil spring 22 is attached to a place at the end of the right pressure lever 18A, and the other end of this coil spring 22 is attached to a frame member 23 affixed to the support frame 9 or access cover 7. As a result, the end of the right pressure lever 18A is urged toward the side of the access cover 7. The left pressure lever 18B is likewise urged to the cover opening and closing mechanism 8 side. The rotation transfer member 20 and operating lever 16 are also urged in the same direction by the urging force from the right pressure lever 18A and left pressure lever 18B. When the cover unit 3 is closed, the operating lever 16 is therefore held in a locked position sloped to the front of the cover unit. As a result, the operating lever 16 will not move accidentally as a result of the printer being tilted or shaken. In addition, the right pressure lever 18A and left pressure lever 18B are held in the locked position across a gap to the pressure surfaces 21A and 21B so that the right pressure lever 18A and left pressure lever 18B do not accidentally push against the pressure surfaces 21A and 21B.

To open the cover, the finger catch 17 of the operating lever 16 is slid toward the back of the cover unit, causing the operating lever 16 to rotate. As a result, rotation of the arm part 16*a* is transferred through the rotation transfer member 20 to the right pressure lever 18A and left pressure lever 18B, the right pressure lever 18A and left pressure lever 18B rotate down toward the housing 2 in resistance to the urging force of the coil spring 22, and the bottom edges 19A, 19B descend and contact the pressure surfaces 21A and 21B. When the finger catch 17 is slid further to the back of the cover unit and the operating lever 16 is rotated further, the parts of the right pressure lever 18A and left pressure lever 18B attached to the rotating support shaft 15 rise to the top of the printer pivoting on the pressure surfaces 21A and 21B. At the same time, the parts of the support frame 9 supporting the ends of the rotating support shaft 15 rise up, and the entire cover opening and closing mechanism 8 including the members attached to the support frame 9 ascend. The cover unit 3 thus moves from the closed position to the open position, and a gap is formed between the end of the access cover 7 and the housing 2.

A cover locking engagement tab 24 is formed at the end part of the support plate 9B extending down toward the bottom of the printer. When the cover unit 3 moves down from the open position to the closed position, the engagement tab 24 engages a catch 25 disposed proximally to the pressure surface 21B. When the cover opening and closing mechanism 8 rises pivoting on the pressure surfaces 21A and 21B as described above, the engagement tab 24 separates from the catch 25 and the cover lock is disengaged. The edge of the access cover 7 floating above the edge of the opening 5 in the housing 2 can then be lifted by hand, and the cover unit 3 can be opened and closed.

Positioning the Pressure Levers

Figure 6A:
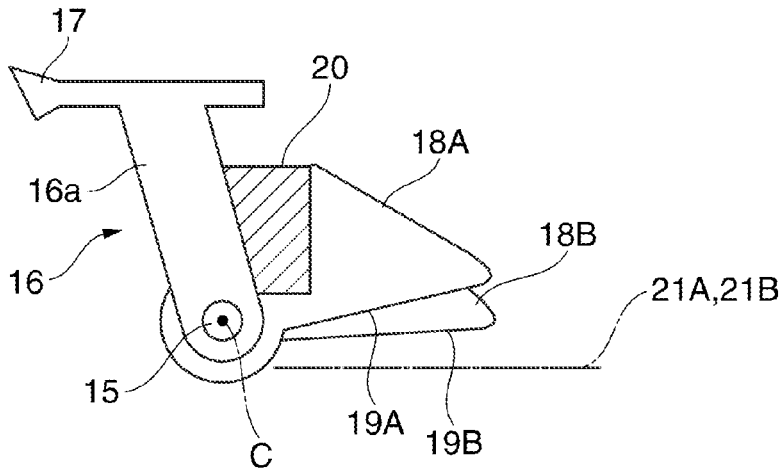
FIG. 6 describes the positions of the operating lever, right pressure lever, and left pressure lever.
Figure 6B:
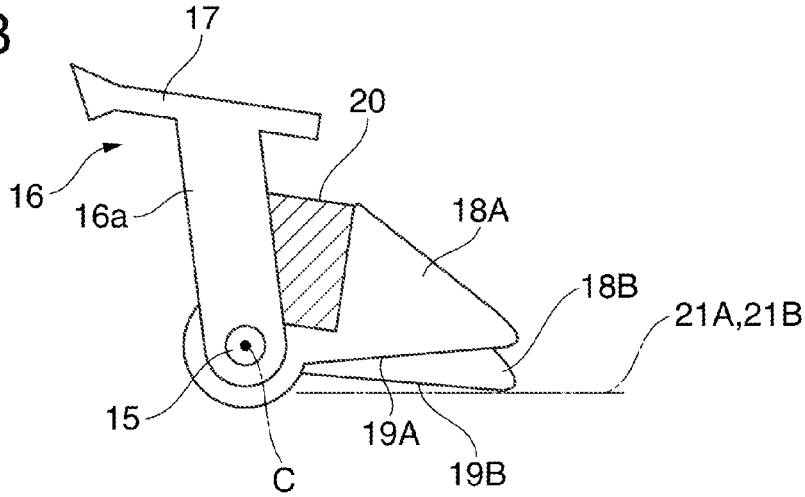
Figure 6C:
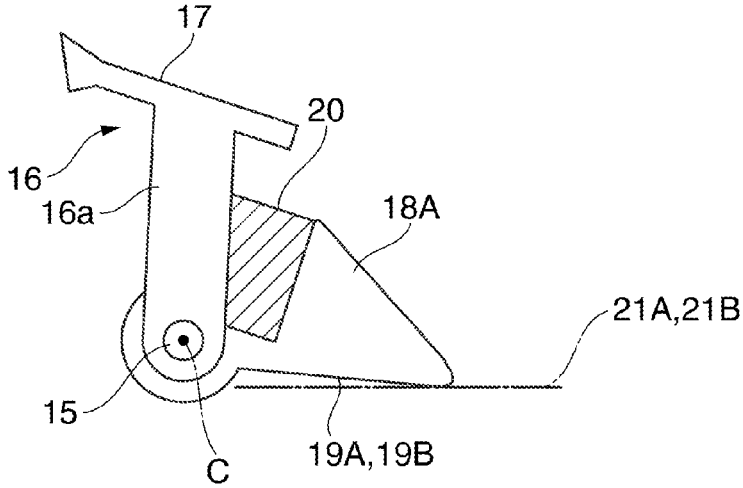

FIG. 6A to FIG. 6C schematically describe the positions of the operating lever, the right pressure lever, and the left pressure lever when the cover unit is closed. The levers are shown as seen from a direction perpendicular to the axis of rotation C of the rotating support shaft 15 in each of the figures. FIG. 6A shows the levers when the operating lever 16 has not moved from the locked position held by the coil spring 22. FIG. 6B shows the levers when the operating lever is rotated to where the left pressure lever contacts the pressure surface. FIG. 6C shows the levers when the operating lever is rotated to just before the access cover is lifted up.

In this embodiment of the invention as shown in FIG. 6A, the positions of the pressure levers are set so that when in the locked position held by the coil spring 22, the bottom edge 19B of the left pressure lever 18B, which is disposed to the rotating support shaft 15 on the opposite side as the operating lever 16, is lower than the bottom edge 19A of the right pressure lever 18A, which is disposed to the rotating support shaft 15 on the same side as the operating lever 16. As a result, when the operating lever 16 is rotated to open the cover unit as described above, the bottom edge 19B of the left pressure lever 18B contacts the pressure surface 21B first as shown in FIG. 6B. In other words, the angle of operating lever 16 rotation at which the left pressure lever 18B contacts the pressure surface 21B is set so that it is smaller than the angle of operating lever 16 rotation at which the right pressure lever 18A contacts the pressure surface 21A.

If the operating lever 16 is rotated further after the left pressure lever 18B contacts the pressure surface 21 B, the end of the rotation transfer member 20 on the left pressure lever 18B side wants to move in the direction causing the left pressure lever 18B to rotate pivoting on the pressure surface 21B in resistance to the load (weight) from the access cover 7 side, but cannot move in resistance to this load. However, the end of the rotation transfer member 20 proximal to the operating lever 16 continues to be pushed by the operating lever 16 and move, causing only the right pressure lever 18A to approach the pressure surface 21A following rotation of the operating lever 16. More specifically, deformation such as twisting or bending is produced in the rotation transfer member 20 at this time. Only the right pressure lever 18A moves while the left pressure lever 18B remains still, and deformation of the rotation transfer member 20 increases.

As shown in FIG. 6C, deformation of the rotation transfer member 20 increases until the bottom edge 19A of the right pressure lever 18A contacts the pressure surface 21A. When the bottom edge 19A of the right pressure lever 18A contacts the pressure surface 21A, the return force from the deformation and the load from the access cover 7 side become balanced. When the operating lever 16 is then rotated further, the right pressure lever 18A and left pressure lever 18B begin to rotate pivoting on the pressure surfaces 21A and 21B in resistance to the load from the access cover 7 side. Because the pressure surfaces 21A and 21B are at the same height in this aspect of the invention, the bottom edges 19A, 19B of the right pressure lever 18A and left pressure lever 18B are at the same rotational position. The rotating support shaft 15, support frame 9, and other parts of the cover opening and closing mechanism 8 therefore rise at the same time on left and right sides, and the left and right sides of the access cover 7 rise at the same time. The access cover 7 can therefore be opened without bending or deflection.

As described above, this embodiment of the invention anticipates deformation of the rotation transfer member 20 caused by the load from the access cover 7 side on the rotation transfer member 20, and sets the positions where the right pressure lever 18A and left pressure lever 18B are formed so that the rotation transfer member 20 deforms during rotation until this load is balanced by the return force of the deformation, and the right pressure lever 18A and left pressure lever 18B then rotate while being held in the same rotational position. More specifically, the bottom edge 19B of the left pressure lever 18B on the side far from the operating lever 16 is set to a lower position than the bottom edge 19A of the right pressure lever 18A so that the bottom edge 19B contacts the pressure surface 21B first, that is, before the bottom edge 19A of the right pressure lever 18A contacts the pressure surface 21A.

Note that while the heights of the pressure surfaces 21A and 21B are the same in this embodiment of the invention, a configuration in which the pressure surfaces 21A and 21B are disposed at different heights, and the positions of the right pressure lever 18A and left pressure lever 18B are offset to compensate for this difference in elevation, is also conceivable. The same effect can also be achieved by forming the right pressure lever 18A and left pressure lever 18B at the same positions (the positions in the no-load state), and offsetting the pressure surfaces 21A and 21B accordingly at different heights. More specifically, any desirable configuration in which the relative positions of the left and right pressure levers to the corresponding pressure surfaces are set so that the pressure surface and the pressure lever on the far side from the operating lever contact first can be used, and the parts that are formed offset in a no-load state can be rendered on either the pressure levers or the pressure surfaces.

This embodiment of the invention can reduce or eliminate the offset in the timing at which the left and right sides of the access cover 7 start to rise without increasing rigidity by rendering the rotation transfer member 20 thicker or sturdier. As a result, deflection of the access cover 7 when opening can be reduced or eliminated, and the cover unit can be opened smoothly, even if the cover unit 3 has a heavy load such as from carrying a platen roller 10. The rotation transfer member 20 can also be rendered in a small space, and cover unit 3 weight can be reduced.

Variations (1) The positions of the right pressure lever 18A and left pressure lever 18B in the foregoing embodiment are set so that the right pressure lever 18A and left pressure lever 18B are at the same rotational position when the access cover 7 rises, but may be set so that the rotational positions of the right pressure lever 18A and left pressure lever 18B are not completely the same when the access cover 7 rises. Even if the rotational positions of the two pressure levers are not completely the same, if at least the left pressure lever 18B on the far side from the operating lever 16 contacts the corresponding pressure surface 21B before the right pressure lever 18A on the near side contacts the pressure surface 21A, deflection of the access cover 7 can be reduced compared with when the right pressure lever 18A and left pressure lever 18B simultaneously contact the pressure surfaces 21A and 21B.

(2) The right pressure lever 18A, left pressure lever 18B, and operating lever 16 are attached freely rotatably to the rotating support shaft 15, and the right pressure lever 18A and left pressure lever 18B rotate according to rotation of the operating lever 16 through the intervening rotation transfer member 20 in the foregoing embodiment, but a configuration in which the right pressure lever 18A, left pressure lever 18B, and operating lever 16 are affixed to the rotating support shaft 15 and rotation is transferred thereto through the rotating support shaft 15 is also conceivable. Because the rotating support shaft 15 also functions as the rotation transfer member in this configuration, the positions where the right pressure lever 18A and left pressure lever 18B are attached can be determined with consideration for the torsion stiffness of the rotating support shaft 15.

(3) Two pressure levers are disposed on the opposite left and right sides of the access cover 7 in the foregoing embodiment, but the two pressure levers are not limited to these positions and could be disposed to two desirable positions offset widthwise to the access cover 7. In this configuration the operating lever 16 is disposed to a position closer to either one of the pressure levers. Pressure levers may also be disposed to three or more positions along the same axis of rotation. In this case the positions of the pressure levers can be set so that the pressure levers contact the case sequentially starting from the pressure lever farthest from the operating lever 16.

(4) The foregoing embodiment describes a configuration in which the cover unit 3 is disposed to the top of the device, but configurations in which the cover unit 3 is attached to a side or front of the device and pivots at the bottom end thereof are also conceivable. In this configuration the positions of the pressure levers can be set according to the load of the rotation transfer member 20 in the closed position. The foregoing embodiment is also described as applied to a cover unit that opens and closes an opening rendered in the case of a thermal printer, but the invention can obviously also be applied to cover units of other types of printers.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A cover unit comprising:

a cover defining a first end supported on a device case and freely rotatable thereon about a first axis of rotation, the cover being movable between a closed position, in which the cover is adjacent the device case, and an open position, in which a second end of the cover is separated from the device case;

a rotation transfer member that is disposed at the second end of the cover, and extends parallel to the first axis of rotation across a width of the cover;

an operating part disposed at a first end of the rotation transfer member;

a first pressure part disposed at the first end of the rotation transfer member;

a second pressure part disposed at a second end of the rotation transfer member; and first and second pressure-bearing parts that are disposed on the device case and are adjacent the first and second pressure parts, respectively, when the cover is in the closed position;

wherein the first and second pressure parts are supported freely rotatably on a second axis of rotation parallel to the first axis of rotation, and wherein the operating part and the pressure parts are operably connected, and wherein the operating part, the pressure parts, and the pressure-bearing parts are relatively configured and located such that the operating part is rotatable between:

a first position, at which neither of the pressure parts contacts a corresponding one of the pressure-bearing parts, and a second position, at which the second pressure part contacts the second pressure-bearing part and the first pressure part does not contact the first pressure-bearing part.

2. The cover unit described in claim 1, wherein the operating part is further rotatable between:

a third position, at which both the first and second pressure parts contact the first and second pressure-bearing parts, respectively; and a fourth position at which the cover starts to move toward the open position.

3. The cover unit described in claim 2, wherein:

the rotation transfer member is configured to be deformed when the operating part rotates from the third to the fourth position; and relative positions of the first and second pressure parts are such that a rotational position of the first pressure part is the same as a rotational position of the second pressure part.

4. The cover unit described in claim 1, wherein:

the rotation transfer member is supported at a back side of the cover facing the device case when the cover is in the closed position; and the operating part is an operating lever that extends through the cover from the back side to a front side of the cover.

5. The cover unit described in claim 1, wherein the device case is a printer.

6. The cover unit described in claim 5, further comprising a platen roller mounted on the cover.

7. A printer comprising the cover unit described in claim 1.

* * * * *